US006312122B1

(12) United States Patent
Brown et al.

(10) Patent No.: US 6,312,122 B1
(45) Date of Patent: Nov. 6, 2001

(54) PRINTING ON A SUBSTRATE

(75) Inventors: Gordon T. Brown, Pittsburgh; Gary Gerard Truchan, Cranberry Township, both of PA (US)

(73) Assignee: Master Image, Inc., Pittsburgh, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/144,004

(22) Filed: Aug. 31, 1998

Related U.S. Application Data

(63) Continuation-in-part of application No. 08/633,675, filed on Apr. 17, 1996.

(51) Int. Cl.[7] ..... B41J 2/01

(52) U.S. Cl. ..... 347/101; 347/105; 156/240

(58) Field of Search ..... 347/101, 100, 347/103, 105, 106, 107; 156/230, 235, 277, 234, 240

(56) References Cited

U.S. PATENT DOCUMENTS

| | | | | |
|---|---|---|---|---|
| 3,829,286 | | 8/1974 | Anzai et al. . | |
| 4,352,721 | | 10/1982 | Park et al. . | |
| 4,395,263 | | 7/1983 | Davis . | |
| 4,411,667 | | 10/1983 | Meredith et al. . | |
| 4,451,335 | | 5/1984 | Woods et al. . | |
| 4,465,489 | | 8/1984 | Jenkins et al. . | |
| 5,531,818 | | 7/1996 | Lin et al. . | |
| 5,554,213 | * | 9/1996 | Radigan, Jr. et al. | 106/22 H |
| 5,555,008 | * | 9/1996 | Stoffel et al. | 347/100 |
| 5,575,877 | * | 11/1996 | Hale et al. | 156/230 X |
| 5,580,410 | | 12/1996 | Johnston . | |
| 5,851,720 | * | 12/1998 | Shinohara | 430/201 |

FOREIGN PATENT DOCUMENTS

4011215A1 10/1990 (DE) .

OTHER PUBLICATIONS

N.A. Pacheva et al., "Chemical Structure and Fastness to Sublimation of Disperse Dyes in Binary Mixtures", translated from *Zhurnal Prikkladnoi Khimii*, Feb. 1975, pp. 385–390, vol. 48, No. 2.

M.S. Searle et al., "The Cost of Conformational Order; Entropy Changes in Molecular Associations", *J. Am. Chem. Soc.*, 1992, pp. 10690–10697, vol. 114.

K. Shinozaki et al., "Dye—Polymer Affinity and Its Effect on Thermal Dye–Transfer Printing", *Journal of Imaging Science and Technology*, Nov./Dec. 1994, vol. 38, No. 6.

M.S. Westwell et al., "Empirical Correlations Between Thermodynamic Properties and Intermolecular Forces", *J. Am. Chem. Soc.*, May 10, 1995, vol. 117, No. 18.

* cited by examiner

*Primary Examiner*—John S. Hilten
*Assistant Examiner*—Minh H. Chau
(74) *Attorney, Agent, or Firm*—Alan G. Towner; Pietragallo, Bosick & Gordon

(57) ABSTRACT

A method of printing on a substrate is disclosed. The method includes depositing an ink on a membrane, placing the membrane in juxtaposition to the surface of the substrate and applying heat and pressure to produce a high quality color control image on the substrate. The ink preferably comprises a thermal transfer dye, a thermal transfer pigment, a protective polymer and a carrier.

15 Claims, 1 Drawing Sheet

PRINTING ON A SUBSTRATE

CROSS REFERENCE TO RELATED APPLICATION

This application is a continuation-in-part of application Ser. No. 08/633,675 filed Apr. 17, 1996, which is incorporated herein by reference.

FIELD OF THE INVENTION

This invention relates to printing on a substrate, and more particularly relates to a method including the steps of depositing an ink comprising a thermal transfer dye, a thermal transfer pigment and/or a protective polymer, and a carrier on a membrane, placing the membrane in juxtaposition to the surface of the substrate, and applying heat and pressure to produce a high quality color control image on the substrate.

BACKGROUND INFORMATION

It is known to produce an image on an impermeable substrate such as aluminum by coating the aluminum with a plastic, depositing ink on a transfer sheet in a desired pattern, and thereafter placing the transfer sheet in juxtaposition to the colored substrate while applying heat and pressure. Some of the ink is transferred from the transfer sheet and bond with the plastic coating to give a printed image on the aluminum coated substrate. Such a process is described in U.S. patent application Ser. No. 751,416, filed Aug. 28, 1991, and U.S. patent application Ser. No. 226,949, filed Apr. 13, 1994. Those processes were subject to the criticism that the images produced were not of consistent quality, did not, in certain cases, bond, did not have the desired resolution, brightness, and color fastness, could not be used on a substrate other than metal, and were limited to one type of polymeric coating.

SUMMARY OF THE INVENTION

We provide a substrate upon which a pattern is to be printed. The substrate may be an impervious material such as aluminum, a thermosetting plastic material, various types of wood and the like. An absorptive and/or an adsorptive and/or bondable surface layer is preferably provided on the substrate. The layer may be an anodized surface on material such as aluminum or a thermo-plastic coating, or the substrate may have a surface which is adsorptive and bondable. An ink is prepared which preferably comprises thermal transfer dye and thermal transfer pigment particles which are preferably milled to be primarily smaller than about 11 microns. The ink may also comprise a protective polymer and a carrier. The ink is deposited on and/or within a membrane in the pattern to be printed. Thereafter, the impregnated membrane is placed in juxtaposition to the absorptive and/or adsorptive bondable layer of the substrate. Heat and pressure are then applied to the impregnated membrane. The thermal transfer dye, thermal transfer pigment and protective polymer, when subjected to heat and pressure, are transferable to the substrate in juxtaposition to the ink by a process which may comprise sublimation, adsorption, melting, entrainment and/or diffusion.

DETAILED DESCRIPTION

Figure 1:
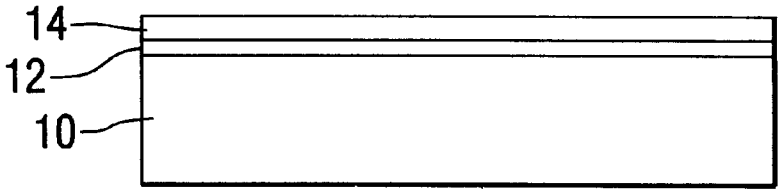
FIGS. 1–3 are schematic drawings illustrating steps in a printing method in accordance with an embodiment of the present invention.
Figure 2:
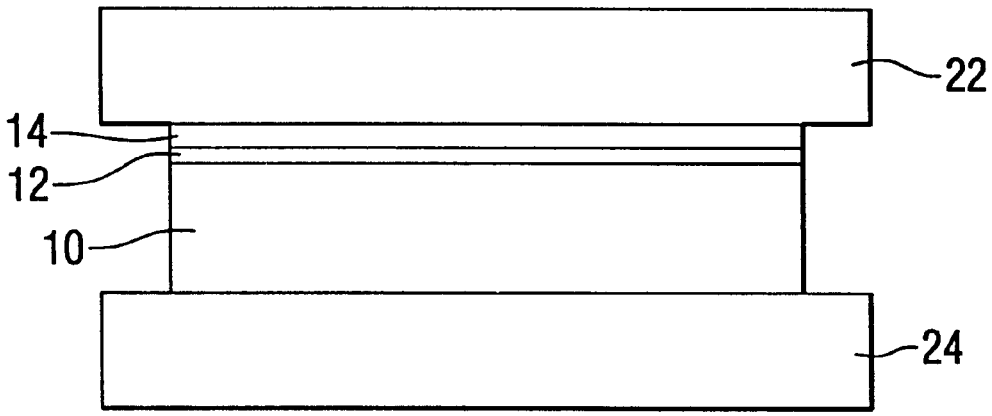
Figure 3:
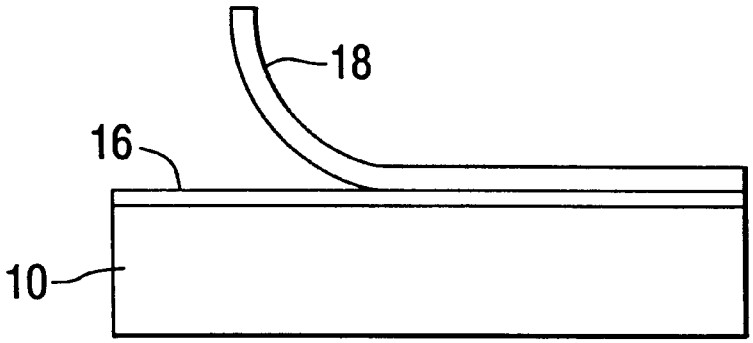

FIGS. 1–3 schematically illustrate a printing process of the present invention. In FIG. 1, a substrate 10 is provided with a surface layer 12. The substrate 10 may be made of any suitable material such as metal, plastic, wood or the like. For example, the substrate 10 may comprise aluminum, tin plate, steel, copper, polyester, polyurethane, acrylic, maplewood, oak, etc. The substrate 10 may be substantially planar as shown in FIG. 1, or may be provided with any desired contour. When a contoured substrate is desired, the shaping operation may be performed prior, during and/or after the printing process.

The substrate 10 may be of any desired thickness. For many applications, a substrate thickness of from about 0.1 mil to about 3 inches may be suitable. For certain types of substrates, a thickness of from about 0.1 to about 1 mil may be preferred, while a thickness of from about 1/16 inch to about 3 inches may be preferred for other types of substrates. For many applications, the substrate may be substantially rigid.

The surface layer 12 shown in FIG. 1 preferably comprises an absorptive and/or an adsorptive and/or bondable material which may include one or more of polyesters, acrylics, polypropylenes, polycarbonates or other polymers. For example, the surface layer 12 may comprise a polyester polymer sold as a "clear coating" by PPG Industries.

The thickness of the surface layer 12 is preferably from about 0.5 mil to about 25 mils, more preferably from about 1 mil to about 3.5 mils. Although a separate surface layer 12 is shown in FIG. 1, in an alternative embodiment, the substrate 10 itself may be sufficiently absorptive and/or adsorptive and/or bondable such that a separate surface layer is not necessary.

As shown in FIG. 1, an impregnated membrane 14 is applied on the surface layer 12. The impregnated membrane 14 preferably comprises a gas permeable membrane made of hollow fiber paper, polymers or other absorbent materials such as nylon, felt, etc. In accordance with the present invention, the membrane is impregnated with an ink comprising a thermal transfer dye, a thermal transfer pigment and alternatively a protective polymer, as more fully described below. As used herein, the term "impregnated" means that the ink is deposited on the surface of the membrane and/or within the membrane. The impregnated membrane 14 preferably has a thickness of from about 2 mils to about 8 mils, more preferably from about 3 mils to about 5 mils.

As shown in FIG. 2, the substrate 10, surface layer 12 and impregnated membrane 14 are positioned between two platens 22 and 24. The platens 22 and 24 apply heat and pressure in order to cause thermal transfer of at least a portion of the thermal transfer dye, thermal transfer pigment and protective polymer from the membrane 14 to the surface layer 12. In the preferred embodiment, the thermal transfer results in the diffusion of at least a portion of the thermal transfer dye and thermal transfer pigment into the surface layer 12.

The platens 22 and 24 are preferably heated to a temperature of from about 280 to about 650° F., more preferably to a temperature of from about 350 to about 450° F. for medium and high energy dyes, the temperature being a function of the amount of pressure and time and the micronization of ingredients in the inks. The platens 22 and 24 preferably apply a pressure of from about 5 psi to about 40 psi, more preferably from about 15 psi to about 25 psi during the transfer process.

As shown in FIG. 3, after the thermal transfer process, an image 16 applied to the surface of the substrate 10 is revealed by removing the spent membrane 18. As more fully described below, due to the use of a thermal transfer dye, a thermal transfer pigment and a protective polymer, the deposited image 16 is characterized by brilliant colors, good color control and precise pattern definition, as well as improved physical and/or visual characteristics provided by the protective polymer.

In accordance with the present invention, the ink used in the printing process may comprise a thermal transfer dye, a thermal transfer pigment and/or a protective polymer, and a carrier. In addition, the ink may further comprise other ingredients such as lubricants, dryers, varnish, polyurethanes, polypropylenes, acrylics and/or polycarbonates.

The thermal transfer dye component of the ink may comprise azo, amino, anthraquinone or other disperse dyes. For example, the thermal transfer dye may comprise Crompton & Knowles Yellow 54, Yellow 238, Orange 25, Red 1, Red 60, Brown 26, Blue 359 and/or Blue 360. Other suitable transfer dyes are commercially available from Gants under the designation disperse dyes, and from Coates under the designation disperse dyes. The thermal transfer dyes are preferably chosen according to color, molecular weight and dye strength. It is noted that fluorescence may be added when the image requires.

The thermal transfer pigment component of the ink may comprise single or multiple pigment systems. For example, the thermal transfer pigment may comprise micronized or nonmicronized blue, red, yellow, or other colorized binding, bonding and/or pigments which may be mixed directly with thermal transfer dyes or microencapsulated within the ink mixture. Suitable transfer pigments are commercially available from American Colors under the designation Single Pigment Systems, from Sun Chemical under the designation Colors Group—Organic Pigments, and from Hangzhou Pigment Chemicals under the designation C.I. Pigments (Organic).

The volume ratio of the thermal transfer dye to thermal transfer pigment preferably ranges from about 2:1 to about 5:1. A particularly preferred ratio is about 3:1.

Preferably, the thermal transfer dye and pigment particles are sized below about 11 microns. The thermal dye and pigment particles preferably have an average particle size range of from about 0.1 to about 1 micron, more preferably from about 0.3 to about 0.4 micron. In some cases, the thermal transfer pigment particles may serve as a binder for the thermal transfer dye particles in the ink and the whole may form a matrix in which the thermal transfer dye, thermal transfer pigment and protective polymer are intermingled.

The protective polymer component of the ink may comprise polyurethanes, acrylics, polypropylenes, polyesters, polycarbonates or polystyrenes, one or more of which may crosslink with the layer on the rigid substrate under the heat and pressure conditions applied. Organic and inorganic polymers serve to facilitate in combination with pigments or separately, under specified heat and pressure, molecular cross-linking and/or bridging among coupling agents. Some suitable protective polymers are commercially available from PPG Industries, Ciba Gigy, Akzo Corporation, Coates, Universal Coatings and others.

The protective polymer may be provided as a separate constituent of the ink composition, or may be provided as a microencapsulant at least partially surrounding the dye and/or pigment particles.

In accordance with the present invention, the use of a protective polymer may facilitate the thermal transfer process, and improves the visual and/or physical characteristics of the printed article. The protective polymer may facilitate the transfer process by controlling dispersion. The amount of polymer depends on the amount of micronized pigments in the inks. Polymers may act in concert with or in lieu of pigments as agents for dispersion control, color stabilization and/or bonding. Dye or pigment stabilization means that dyes or pigments are transferred accurately from the membrane to the exact point of reference on the metal, plastic or wood substrate without color blowouts or excessive dispersion. Bonding of the dyes and/or pigments with polymers and/or pigments in the layer on the substrate is facilitated through polymeric cross-linking.

The protective polymer also improves the visual and/or physical characteristics of the printed article. For example, the presence of the protective polymer may substantially improve hardness, wear resistance, flexibility, bonding, color fastness, ultraviolet ray protection, dye stabilization and pigment stabilization. In the case of ultraviolet ray protection, tinuvin series and other UV blockers and UV scavengers have doubled the life of images placed in outdoor test areas. In the case of deformation, elastomers supplied by PPG Industries have been found to improve the bendability to 90° to 120° dependent upon the application and the substrate. These additives may be included in the ink mixture, the printable and bondable layer or both. In addition, applying an overcoat comprising these polymer additives has proven to enhance the final product.

The carrier component may comprise free-flow varnish, base varnish, dryers, oils and/or lubricants. For example, the carrier may comprise free-flow varnish, base varnish, cobalt dryer, magie oil and/or manganese dryer. Suitable carriers are commercially available from Sheppard Corp. under the designation K-Series Varnishes, Magie Corp. under the designation Magie 51 Oil, and Sheppard Corp. under the designation Fast-Acting Print Dryers.

The ink of the present invention may be made, for example, by mixing the thermal transfer dye, thermal transfer pigment and protective polymer into the carrier. Before or after mixing, the thermal transfer dye and pigment particles are preferably milled to reduce the majority of the particles to a size range of 11 microns or less.

In accordance with the present invention, the ink is impregnated onto or into a membrane. The membrane may comprise hollow fiber paper, polymer coated paper, synthetic paper, polished paper or other plasticized media. Suitable membranes are commercially available from International Paper under the designation Hollow Fiber Print Stock or from Mead Paper Corp.

The membrane may be impregnated with the ink by any suitable process such as flexographic offset printing, lithography or computer ink dispersement and deposit devices. For example, a separate ink composition may be prepared for each color to be used. Each ink is then transferred to a printing plate and then by the printing plate to a substrate on which the final image is to be placed either directly or through an intermediate step. A printing plate, as the term is used herein, is any device by which an ink may be transferred in a predetermined pattern to another object or surface. The printing plate may be, for example, a conventional copper plate, a stereotype plate, a transfer blanket used in lithography, or an ink jet printer programmed to deposit ink in a predetermined pattern. Preferably, each ink is deposited on or within a gas permeable membrane in the pattern to be printed.

The use of specific thermal transfer dyes are determined by the image to be printed and the preferred substrate characteristics. Thermal transfer pigments, protective polymers and carriers are added according to the color and molecular weight of the thermal transfer dye employed. The combination of ingredients for each dye/pigment color is color and weight balanced to achieve similar viscosities among the colors to be printed on the membrane using, for example, flexographic offset processes.

As shown in FIG. 1, the impregnated membrane 14 is applied to the surface layer 12 of the substrate 10. The surface layer 12 may comprise polyesters, acrylics, polystyrenes, polyurethanes or anodized materials. Suitable surface layers are paint and coating systems commercially available from PPG Industries, Universal Coatings, Akzo Coatings, Interpon, Ciba Gigy.

As discussed previously, the substrate may be any of a wide variety of materials having an absorptive, adsorptive or bondable layer. The substrate may be, for example, an essentially impervious material, such as aluminum, coated with a thermoplastic resin. Alternatively, an impervious material such as glass or a thermosetting resin may be coated with a thermoplastic resin to provide such a layer. As another example, the substrate could also be an aluminum sheet having an anodized surface layer which is receptive to the ink.

After the desired ink pattern has been transferred to the gas permeable membrane, the membrane and the substrate are placed in juxtaposition in a press where they are subjected to heat and pressure, preferably on the order of 300° F. or more and one psi or more, as schematically illustrated in FIG. 2. The ink is believed to melt, vaporize and/or sublime, transferring at least partially to the surface of the substrate and forming a matrix therewith. The substrate and the membrane are then removed from the press and allowed to cool, and the spent membrane is stripped from the surface of the substrate, as shown in FIG. 3. Some of the ink may be retained in the membrane and the pattern may be discernible in the membrane albeit in faded form. The ink deposit on the substrate is characterized by brilliant colors, good color control, and precise pattern definition far in excess of prior known practices. In addition, due to the presence of the protective polymer, the printed article has substantially improved visual and/or physical characteristics.

The following examples are intended to illustrate various aspects of the present invention, are not intended to limit the scope thereof.

EXAMPLE 1

An ink is prepared by mixing 30 volume percent of a thermal transfer dye, 10 volume percent of a thermal transfer pigment, 10 volume percent of a protective polymer, and 40 volume percent of a carrier. Prior to mixing, the thermal transfer dye and the thermal transfer pigment are milled to an average particle size of about 0.5 micron. The thermal transfer dye is a disperse and is obtained from Crompton & Knowles under the designation Series 1300. The thermal transfer pigment is red base and is obtained from Crompton & Knowles and designated organic. The protective polymer is in the acrylic family and is obtained from Cytex Corporation. The carrier is a free-flow varnish and is obtained from Sheppard Corp. After mixing, the ink is applied to a membrane by a flexographic offset printing press, spreading one or more colors at a time wherein the appropriate amounts of inks are deposited evenly on the membrane in the pattern that is to be heat transferred to the layer on or within the rigid substrate. The membrane has a thickness of about 3 mils, a width of about 28 inches and a length of about 40 inches. The membrane has a composition of hollow fiber paper, and is commercially available from International Paper Co. designated and labelled for use by its weight equivalence. A substrate made of aluminum having a thickness of about 0.0165 gauge, a width of about 28 inches and a length of about 40 inches is provided. A surface layer made of acrylic having a thickness of about 1 mil is applied to the substrate by the process of roll coating. The coating which forms the surface layer is commercially available from PPG Industries. The impregnated membrane is then placed over the surface layer and the laminated structure is placed between two platens. The platens are heated to a temperature of 360° F., and a pressure of 20 psi is applied against the laminated structure for 30 seconds. After the heated platens are removed from the laminated structure, the spent membrane is peeled away to reveal a printed image on the substrate. The resultant printed image has excellent color characteristics and a precise pattern definition of greater than 200 screen lines of resolution. The printed image also has improved physical characteristics of color fastness, abrasion resistance and formability due to the presence of the protective polymer.

While we have illustrated and described present preferred embodiments of the invention, it is to be understood that the invention is not limited thereto and may be otherwise variously practiced within the scope of the following claims.

What is claimed is:

1. A method of printing on a substrate, the method comprising;

preparing an ink comprising a thermal transfer dye, a carrier and at least one material selected from a thermal transfer pigment and a protective polymer;

impregnating a membrane with the ink in a pattern corresponding to an image to be printed;

placing the impregnated membrane in juxtaposition to the substrate; and applying heat and pressure to the impregnated membrane to transfer at least a portion of the thermal transfer dye and the at least one thermal transfer pigment and protective polymer to the substrate to thereby form an image, wherein at least a portion of the image has a resolution of at least about 200 lines per inch.

2. The method of claim 1, wherein the ink comprises both the thermal transfer pigment and the protective polymer.

3. The method of claim 2, wherein the thermal transfer dye and the thermal transfer pigment comprise particles having an average size of less than about 11 microns.

4. The method of claim 2, wherein the thermal transfer dye and the thermal transfer pigment comprise particles having an average size of from about 0.1 to about 1 micron.

5. The method of claim 2, wherein the volume ratio of the thermal transfer dye to the thermal transfer pigment is from about 2:1 to about 5:1.

6. The method of claim 2, wherein the protective polymer comprises less than about 30 volume percent of the ink.

7. The method of claim 2, wherein the protective polymer comprises from about 1 to about 20 volume percent of the ink.

8. The method of claim 1, wherein the substrate is substantially rigid.

9. The method of claim 1, further comprising shaping the substrate to provide a contoured substrate.

10. The method of claim 9, wherein the shaping step is performed before or after the application of heat and pressure.

11. The method of claim 1, wherein the substrate comprises at least one material selected from metal, plastic and wood.

12. The method of claim 1, further comprising providing the substrate with a surface layer prior to the placement of the impregnated membrane thereon.

13. A method of printing on a substrate, the method comprising:

preparing an ink comprising a thermal transfer dye, a carrier and at least one material selected from a thermal transfer pigment and a protective polymer;

impregnating a membrane with the ink in the pattern corresponding to an image to be printed;

placing the impregnated membrane in the juxtaposition to the substrate;

applying heat and pressure to the impregnated membrane to transfer at least a portion of the thermal transfer dye and the at least one thermal transfer pigment and protective polymer to the substrate to thereby form an image; and bending the substrate.

14. The method of claim 13, wherein the bending of the substrate occurs after the application of heat and pressure.

15. The method of claim 13, wherein upon the application of heat and pressure and image is formed on the substrate and at least a portion of the image has a resolution of at least about 200 lines per inch.

* * * * *

UNITED STATES PATENT AND TRADEMARK OFFICE

CERTIFICATE OF CORRECTION

PATENT NO. : 6,312,122 B1
DATED : November 6, 2001
INVENTOR(S) : Gordon T. Brown et al.

It is certified that error appears in the above-identified patent and that said Letters Patent is hereby corrected as shown below:

Column 8,
Line 11, “and” should read -- an --.

Signed and Sealed this

Twenty-seventh Day of July, 2004

JON W. DUDAS
*Acting Director of the United States Patent and Trademark Office*